United States Patent [19]

Hartnett

[11] Patent Number: 5,022,207

[45] Date of Patent: Jun. 11, 1991

[54] BUILDING PANEL HAVING LOCKING FLANGE AND LOCKING RECEPTACLE

[75] Inventor: G. Robert Hartnett, Peoria, Ill.

[73] Assignee: Aluminum Company of America, Pittsburgh, Pa.

[21] Appl. No.: 459,944

[22] Filed: Jan. 2, 1990

[51] Int. Cl.[5] ..... E04C 2/20; E04C 2/30

[52] U.S. Cl. ..... 52/537; 52/478; 52/525; 52/526; 52/527; 52/528; 52/531

[58] Field of Search ..... 52/537, 525-531, 52/478

[56] References Cited

U.S. PATENT DOCUMENTS

| | | | |
|---|---|---|---|
| 411,683 | 9/1889 | Sagendorph | 52/528 |
| 2,486,326 | 10/1949 | Ronzone | 52/526 X |
| 2,766,861 | 10/1956 | Abramson | 52/531 |
| 3,325,952 | 6/1967 | Trachtenberg | 52/276 |
| 3,376,683 | 4/1968 | Epstein | 52/531 X |
| 3,461,628 | 8/1969 | Wienand et al. | 52/531 |
| 3,473,274 | 10/1969 | Godes | 52/127 |
| 3,759,007 | 9/1973 | Thiele | 52/537 X |
| 3,977,145 | 8/1976 | Dobby et al. | 52/531 |
| 4,189,885 | 2/1980 | Fritz | 52/287 |
| 4,316,351 | 2/1982 | Ting | 52/478 X |
| 4,450,665 | 5/1984 | Katz | 52/522 |
| 4,461,128 | 7/1984 | Knoebl | 52/94 |
| 4,736,565 | 4/1988 | Bisson | 52/526 |
| 4,864,788 | 9/1989 | Tippman | 52/529 X |

*Primary Examiner*—David A. Scherbel
*Assistant Examiner*—Deborah McGann Ripley
*Attorney, Agent, or Firm*—Glenn E. Klepac

[57] ABSTRACT

A building panel useful as vinyl soffit in residential construction. The building panel comprises a principal portion, a locking flange, and a locking receptacle interlocking with the locking flange of an adjacent panel. The building panel is easy to assemble and combines high strength with a pleasant appearance.

16 Claims, 2 Drawing Sheets

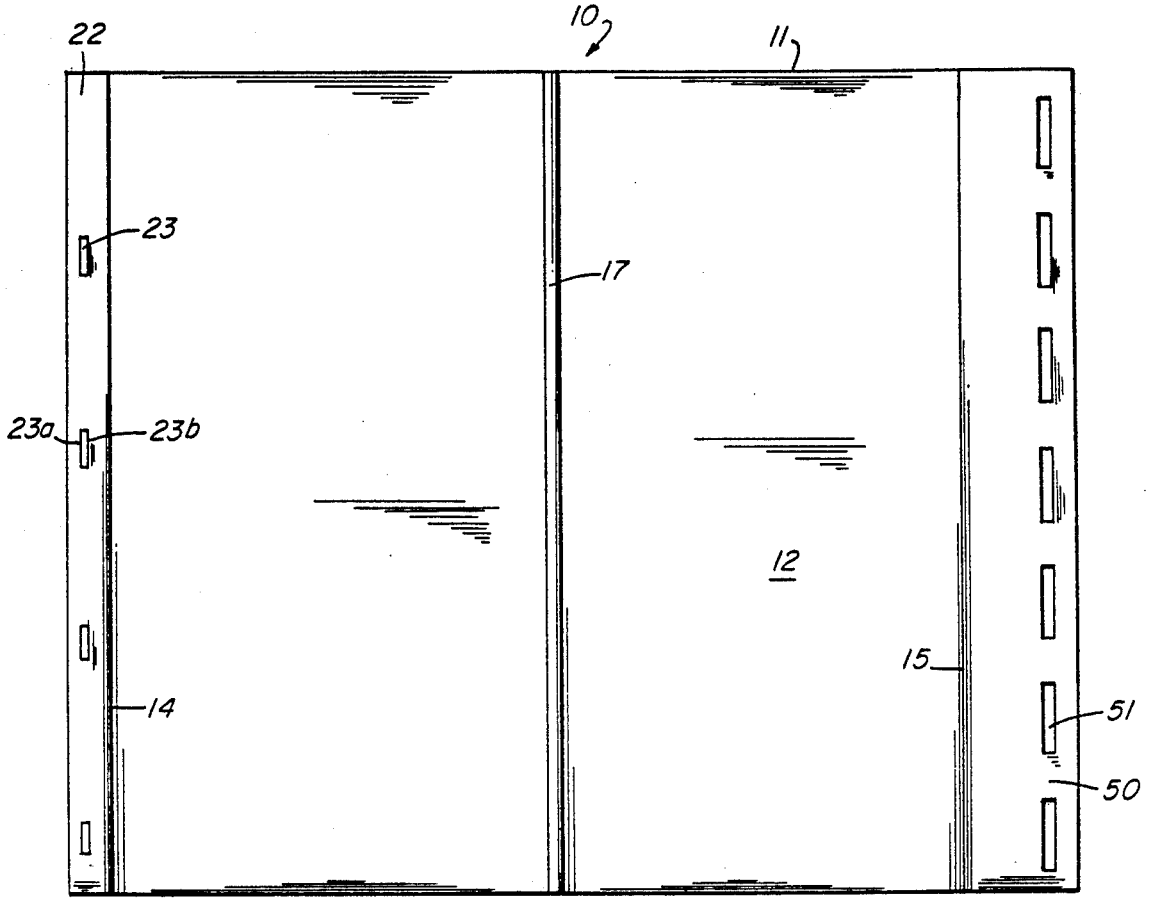
FIG. 1
FIG. 2
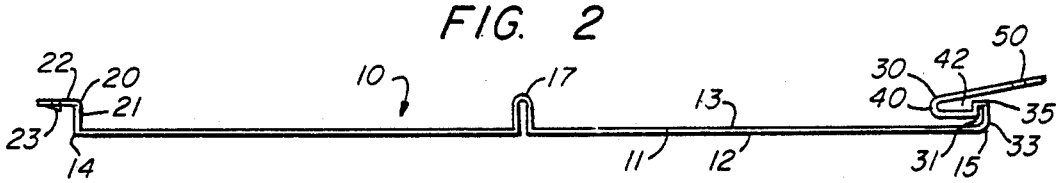
FIG. 3
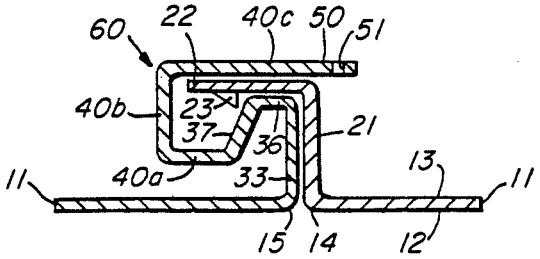

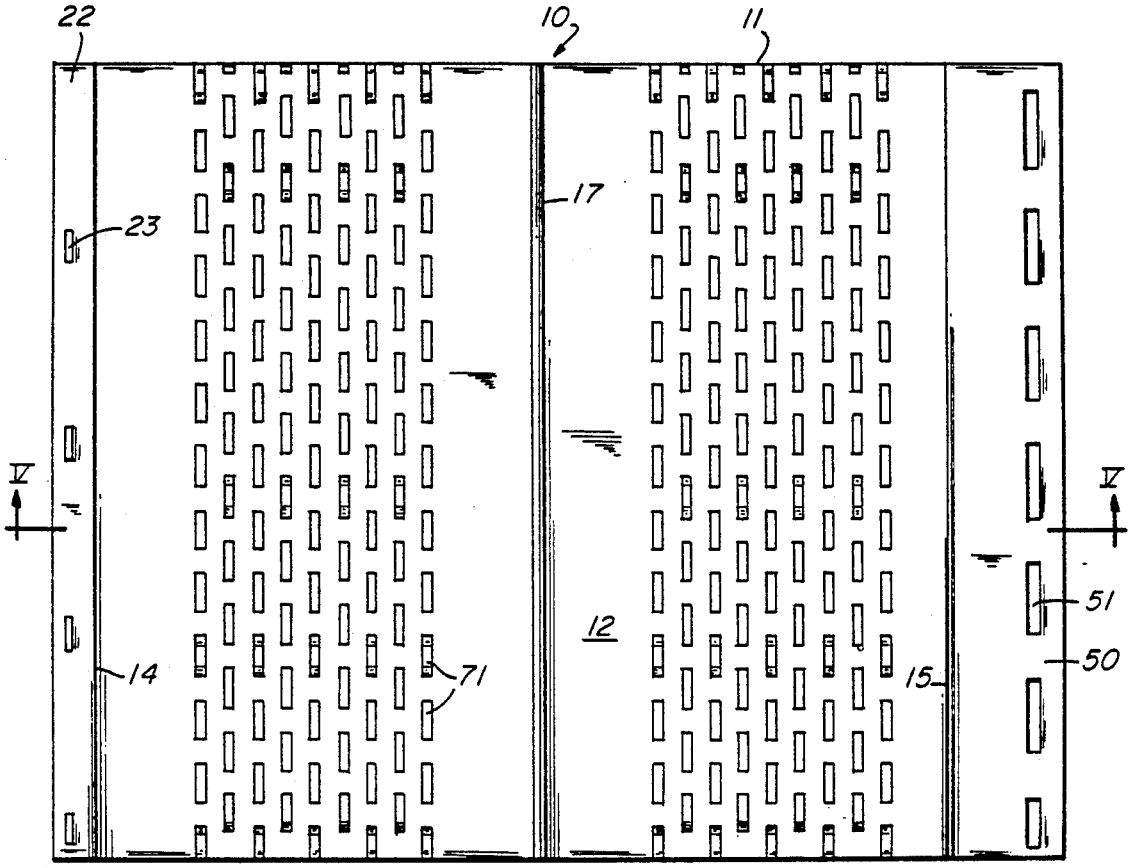
FIG. 4
FIG. 5
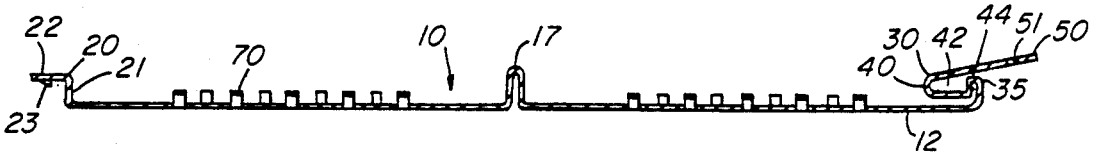

BUILDING PANEL HAVING LOCKING FLANGE AND LOCKING RECEPTACLE

FIELD OF THE INVENTION

The present invention relates to a building panel for residential buildings and similar structures. More particularly, the invention relates to a vinyl soffit panel having an improved means for interlocking engagement with adjacent similar panels.

BACKGROUND OF THE INVENTION

Vinyl soffit units are known in the prior art. However, the prior art soffit units are generally difficult to manufacture and assemble, and they sometimes also have less than optimal strength and appearance.

Knoebl U.S. Pat. No. 4,461,128 issued July 24, 1984 discloses vinyl soffit configured for interlock with adjacent units and with supporting J-shaped or F-shaped channels. The Knoebl soffit panels appear to be made by a profile extrusion process whereas the building panels claimed herein are manufactured by a post forming extrusion process.

Some other references disclosing vinyl or metal building units adapted for interlock with adjacent units are Trachtenberg U.S. Pat. No. 3,325,952; Godes U.S. Pat. No. 3,473,274; Fritz U.S. Pat. No. 4,189,885; and Katz U.S. Pat. No. 4,450,665. Such references do not disclose or suggest a vinyl soffit panel having an integrally formed locking flange and locking receptacle as claimed herein.

A principal object of the present invention is to provide a building panel made from a synthetic polymer and having a locking flange and a locking receptacle configured for interlocking engagement. A related objective of the invention is to provide a building panel that is easy to manufacture and to assemble.

A further objective of the invention is to provide a building panel of the type described having high strength and a pleasant appearance.

Additional objectives and advantages of the invention will become apparent to persons skilled in the art from the following detailed description.

SUMMARY OF THE INVENTION

In accordance with the present invention there is provided a building panel made from a synthetic polymer and configured for interlocking engagement with adjacent similar panels. The building panel preferably comprises vinyl soffit but may also be used for other purposes such as siding material.

The building panel of the invention comprises a principal portion, a locking flange, and a locking receptacle adapted to interlock with a locking flange on an adjacent unit.

The principal portion has front and rear surfaces and spaced first and second lateral end portions. The front surface is generally flat, but may be interrupted by one or more indented, longitudinally extending ribs for added strength. The principal portion may also have vent openings, when desired to prevent undue accumulation of attic moisture.

The locking flange extends from the first lateral end portion of the principal portion. The flange comprises a leg extending rearwardly of the principal portion, a locking tab extending laterally outward of the leg behind the principal panel and a locking lug extending frontward from the locking tab. The locking flange is preferably generally L-shaped in cross-section.

The locking receptacle is attached to the second lateral end portion of the principal portion. The locking receptacle comprises an arm extending rearwardly from the principal portion, a flap attached to the arm, and a fastening strip extending laterally outward from the flap. The arm is preferably generally J-shaped in cross-section, comprising a connecting piece attached to the second lateral end portion and a curved elbow attached to the connecting piece. The flap is preferably C-shaped in cross-section. The flap and the arm define a locking notch for receiving a locking lug from an adjacent building panel. The locking tab enters the locking receptacle through a narrow passageway between the elbow and flap.

A fastening strip extends laterally outward from the flap. The fastening strip defines a plurality of fastening slots or nailing slots. The soffit panel is fixed in place by driving nails through these slots into wood studs at the construction site.

The vinyl soffit panel of the invention is manufactured by post forming extrusion. In this process, molten polymer material is extruded into a continuous sheet which is then punched to form fastening slots in the fastening strip and locking lugs in the locking tab. If desired, vent openings may also be provided in the principal portion.

BRIEF DESCRIPTION OF THE DRAWINGS

FIG. 1 is a front elevational view of a preferred building panel made in accordance with the present invention.

FIG. 2 is a side elevational view of the building panel of FIG. 1.

FIG. 3 is an enlarged, fragmentary cross-sectional view of two interlocked building panels made in accordance with the invention.

FIG. 4 is a front elevational view of an alternative building panel made in accordance with the invention.

FIG. 5 is a cross-sectional view taken along the lines V—V of FIG. 4.

DETAILED DESCRIPTION OF A PREFERRED EMBODIMENT

A particularly preferred building panel or building unit 10 made in accordance with the present invention is shown in FIGS. 1 and 2. The building panel 10 principally comprises polyvinyl chloride and is intended for use as soffit in residential housing.

The soffit panel 10 comprises a principal portion 11 having a front surface or bottom surface 12 and rear surface or top surface 13. The portion 11 extends between a first lateral end portion 14 and a second lateral end portion 15. The portion 11 is preferably divided by a longitudinally extending, rearwardly depressed integral rib 17 approximately midway between the two lateral end portions 14, 15. The rib 17 adds rigidity to the portion 11.

A locking flange 20 extends from the first lateral end portion 14. The locking flange 20 includes a rearwardly or upwardly extending leg 21; a locking tab 22 extending laterally outward from the leg 21 behind the principal portion 11; and a locking lug 23 extending frontward or downward from the locking tab 22. As shown in FIG. 3, the locking flange 20 is generally L-shaped in cross-section.

The locking lug 23 is formed by displacing a portion of the tab 22 forwardly, so that an outer end 23*a* (FIG. 1) remains attached to the tab 22 and an inner end 23*b* (FIG. 1) is spaced frontward or downward from the tab 22. The tab 22 is formed with four small locking lugs 23 each spaced apart by a distance of a few inches as shown in FIG. 1.

A locking receptacle 30 extends from the second lateral end portion 15. The locking receptacle 30 has a complex shape comprising an arm 31 attached directly to the principal portion 11; a flap 40 attached to the arm 31; and a fastening strip or nailing strip 50 attached to the flap 40. The fastening strip 50 defines several spaced fastening slots or nailing slots 51.

The arm 31 comprises a connecting piece 33 attached to the second lateral end portion 15 and extending rearwardly. A curved elbow 35 is attached to the connecting piece 33. As shown in FIG. 3, the elbow comprises a first portion 36 extending laterally inward of the end portion 15 and a second portion 37 extending frontward of the first portion 36.

The flap 40 is attached to the elbow 35. The flap 40 is generally C-shaped in cross-section as shown in FIG. 3. The flap 40 comprises a laterally inwardly extending leg 40*a;* a rearwardly extending connector 40*b;* and a wing 40*c* attached to the connector 40*b* and extending laterally outwardly thereof. The wing 40*c* overlaps the arm 31. The flap 40 and arm 31 combine to define a locking notch 42 for receiving a locking lug 23 from an adjacent building unit. Entry to the locking notch 42 is obtained through a narrow passageway 44 between the elbow first portion 36 and wing 40*c*.

Referring to FIGS. 1 and 3, a fastening strip or nailing strip 50 extends laterally outward from the wing 40*c*. The fastening strip 50 defines several rectangular fastening slots or nailing slots 51. The soffit panel 10 is fixed to a building by driving nails through these slots 51 and into wood studs (not shown).

In FIG. 3, there is shown a joint 60 between two adjacent building panels of the present invention. When joined together as shown, the locking lugs 23 of one panel are firmly engaged in a locking notch 42 in the adjacent panel. Sizes of the passageway 44 and lug 23 are carefully controlled to prevent inadvertent detachment of the locking tab 22 from the locking notch 42.

An alternative embodiment of the building unit 10 is illustrated in FIGS. 4 and 5. In this embodiment, several vent openings 70 are formed in the principal panel 11. Such openings 70 are manufactured by die punching several small parts 71 of the principal panel 11 rearwardly so that such parts 71 remain only partially attached to the panel 11. The vent openings 70 provide sufficient ventilation to prevent excessive accumulation of attic moisture in moist climates.

The foregoing description of my invention has been made with reference to two preferred embodiments. Persons skilled in the art will understand that numerous changes and modifications can be made therein without departing from the spirit and scope of the following claims.

I claim:

1. A building panel made from a synthetic polymer and configured for interlocking engagement with adjacent panels, said building panel comprising:

(a) a principal portion having a front surface and first and second lateral end portions;

(b) a locking flange extending from said first lateral end portion and comprising:

(1) a leg extending rearwardly of said principal portion;

(2) a locking tab extending laterally outward of said leg rearward of said principal portion; and, (3) a locking lug extending frontward from said locking tab; and (c) a locking receptacle extending from said second lateral end portion and, comprising:

(1) an arm extending rearward of said principal portion, said arm comprising a connecting piece extending from said second lateral end portion and an elbow extending from said connecting piece, said elbow comprising a first portion extending laterally inward and a second portion extending frontward of said first portion;

(2) a flap comprising a leg extending laterally inward from said second portion, a connector extending rearwardly from said leg, and a wing extending from said connector laterally outward, said wing being in a parallel relationship with said leg, said flap and said second portion defining a locking notch for receiving a locking lug from an adjacent panel, said flap and said first portion defining a passageway narrower than said locking tab and locking lug for retention of the locking tab in said locking notch; and (3) a fastening strip extending rearwardly of said wing and laterally outward from said flap, said fastening strip defining a fastening slot.

2. The building panel of claim 1 wherein said principal panel, said locking flange and said locking receptacle are integrally formed from a single, continuous sheet of synthetic polymer material.

3. The building panel of claim 1 wherein said locking flange is generally L-shaped in cross-section.

4. The building panel of claim 1 wherein said arm is generally J-shaped in cross-section.

5. The building panel of claim 1 wherein said flap is generally C-shaped in cross-section.

6. The building panel of claim 1 wherein said wing overlaps said elbow; said wing and said elbow defining said passageway.

7. The building panel of claim 1 wherein said locking lug is formed by displacing a portion of said tab frontwardly, said locking lug comprising an outer end attached to said tab and an inner end spaced frontward of said tab and laterally inward from said outer end.

8. The building panel of claim 1 wherein said fastening strip defines a plurality of spaced fastening slots.

9. The building panel of claim 1 wherein said front surface comprises a generally planar main portion.

10. The building panel of claim 9 wherein said principal portion defines a plurality of vent openings.

11. The building panel of claim 1 wherein said locking lug comprises a plurality of discrete, spaced locking lugs.

12. A vinyl soffit panel formed from a single continuous strip and comprising:

(a) a generally planar principal portion having a bottom surface and first and second spaced lateral end portions;

(b) a generally L-shaped locking flange integrally formed with said principal portion and extending from said first lateral end portion, said locking flange comprising:

(1) a leg extending upwardly of said principal portion;

(2) a locking tab extending laterally outward of said leg upward of said principal panel; and, (3) a locking lug extending downward from said locking tab; and (c) a locking receptacle integrally formed with said principal portion and extending from said second lateral end, portion, said locking receptacle comprising:

(1) a generally J-shaped arm extending upwardly of said principal portion, said arm comprising a connecting piece extending from said second lateral end portion and an elbow extending from said connecting piece;

(2) a generally C-shaped flap attached to said elbow and looped around said arm, said flap and said arm defining a locking notch for receiving a locking lug from an adjacent unit, said flap and said elbow defining a passageway narrower in vertical extent than said locking tab and locking lug; and, (3) a fastening strip extending rearwardly of said wing and laterally outward from said flap.

13. The vinyl soffit panel of claim 12 wherein said fastening strip defines a plurality of spaced fastening slots.

14. The vinyl soffit panel of claim 12 wherein said flap comprises a laterally inwardly extending leg attached to said elbow; an upwardly extending connector attached to said leg; and a wing attached to the connector and extending laterally outwardly thereof, said wing overlapping said elbow and defining said passageway.

15. The vinyl soffit panel of claim 12 wherein said locking lug is formed by displacing a portion of said tab downwardly, said locking lug comprising an outer end attached to said tab and an inner end spaced downward of said tab and laterally inward from said outer end.

16. The vinyl soffit panel of claim 12 wherein said locking lug comprises a plurality of spaced locking lugs.

* * * * *